US005386217A

United States Patent [19]

Liu et al.

[11] Patent Number: 5,386,217

[45] Date of Patent: Jan. 31, 1995

[54] METHOD FOR CONTROLLING A LIQUID CRYSTAL DISPLAY MODULE TO SHOW INTERLACED PICTURE DATA THEREON

[75] Inventors: Hsiung-Hao Liu; Der-Clng Shyn; Lioa-Shun Cheng; Chen-Tsu Chiu, all of Hsinchu, Taiwan, Prov. of China

[73] Assignee: Winbond Electronic Corp., Hsinchu, Taiwan, Prov. of China

[21] Appl. No.: 106,889

[22] Filed: Aug. 16, 1993

[51] Int. Cl.[6] ..... G09G 3/36

[52] U.S. Cl. ..... 345/99; 345/103; 345/94; 348/550

[58] Field of Search ..... 358/152; 345/94, 98, 345/99, 213, 96, 87, 103; 348/550

[56] References Cited

U.S. PATENT DOCUMENTS

| | | | |
|---|---|---|---|
| 4,745,485 | 5/1988 | Iwasaki | 345/98 |
| 4,816,816 | 3/1989 | Usui | 345/94 |
| 4,845,473 | 7/1989 | Matsuhashi et al. | 345/94 |
| 5,018,076 | 5/1991 | Johary et al. | 345/87 |

*Primary Examiner*—Alvin E. Oberley
*Assistant Examiner*—Minsun Oh
*Attorney, Agent, or Firm*—Harness, Dickey & Pierce

[57] ABSTRACT

A method for controlling a liquid crystal display (LCD) module to show interlaced picture data thereon includes the step of providing a data field of the interlaced picture data, which data field includes a series of line picture data, to the LCD module. Twin line clock pulses are then provided to the LCD module to control latching of each line picture data thereby. Finally, a frame start pulse is provided to the LCD module whenever a first one of the line picture data is provided to the LCD module. The width of the frame start pulse is varied so that the LCD module can show the first one of the line picture data on a first even line thereof when the data field is an even data field and on a first odd line thereof when the data field is an odd data field. The twin line clock pulses and the frame start pulse ensure that the line picture data of the even and odd data fields are shown alternately and respectively on even and odd lines of the LCD module.

6 Claims, 6 Drawing Sheets

METHOD FOR CONTROLLING A LIQUID CRYSTAL DISPLAY MODULE TO SHOW INTERLACED PICTURE DATA THEREON

BACKGROUND OF THE INVENTION

1. Field of the Invention

The invention relates to a liquid crystal display module, more particularly to a method for controlling a liquid crystal display (LCD) module to show interlaced picture data thereon.

2. Description of the Related Art

A sequential scanning system is employed in the monitors of conventional personal computers. Referring to FIG. 1, scanning starts at the upper left hand corner of the monitor and moves toward the right along a nearly horizontal first line. At the end of the first line, a quick return is made to the left-hand side to start the scanning of a succeeding line, again moving toward the right. When all lines have been scanned in this way, from top to bottom, the process is repeated by returning quickly to the upper left-hand corner. Usually, a 60 Hz frame rate is employed. A main drawback of the sequential scanning system is that the resolution cannot be effectively increased.

Another type of scanning system is employed in conventional television sets. In an interlaced scanning system, odd-numbered lines are scanned first, and the even-numbered lines are scanned next. Thus, a single picture data frame consists of odd and even fields. Referring to FIG. 2, the scanning process begins at the upper left hand corner of the television screen and moves toward the right along a nearly horizontal first odd line. At the end of the first odd line, a quick return is made to the left-hand side to start the scanning of a succeeding odd line, again moving toward the right. Scanning of the odd field ends at the middle bottom of the screen. The scanning process is continued by moving quickly the scanning beam to the top center of the television screen during a vertical retrace interval to initiate scanning of the even field. When scanning the even field, the scanning process moves toward the right along a nearly horizontal first even line. At the end of the first even line, a quick return is made to the left-hand side to start the scanning of a succeeding even line, again moving toward the right. Note that the lines of the even field fall between the lines of the odd field. Scanning of the even field ends at the lower right corner of the television screen.

The interlaced scanning system permits a lower display clock rate while achieving a higher resolution. The frame rate for the interlaced scanning system is reduced to 30 Hz.

Referring to FIG. 3, a conventional LCD system is shown to comprise a central processing unit (CPU) 8, a display controller 9, a display memory 10 and an LCD module 11. The CPU 8 sends picture data to the display controller 9 for storage in the display memory 10. When it is desired to show the picture data on the LCD module 11, the display controller 9 retrieves the data from the display memory 10 and provides the same to the LCD module 11. The display controller 9 generates a shift clock signal, a line clock signal and a frame start signal to the LCD module 11 in order to control the display of the picture data on the LCD module 11.

Conventional LCD modules use a sequential scanning system instead of an interlaced scanning system. Referring to FIG. 4, a conventional 640×480 twin-panel LCD module includes upper and lower LCD panels 12, 13. Referring to FIG. 5, a pixel clock signal 14, a shift clock signal 15, a line clock signal 16 and a frame start signal 17 are used to control the viewing of picture data on the LCD module. A shift clock pulse (SC1, SC2, SC3, . . . SC160) is generated during the duration of four pixel clock pulses (D0, D1, D2, D3, . . . D636, D637, D638, D639). Four pixels of picture data have been sent at this stage. Each pixel of picture data may include a number of bits to indicate the tone and color of the same. A line clock pulse (LC1, . . . LC240) is generated after one hundred and sixty shift clock pulses (SC1, SC2, SC3, . . . SC160) have been generated in order to control latching of one line of picture data. In the conventional twin-panel LCD module, picture data is shown simultaneously on the upper and lower LCD panels 12, 13 of the LCD module. The upper and lower LCD panels 12, 13 require two hundred and forty lines of picture data to constitute one frame of picture data. Each line of the upper and lower LCD panels 12, 13 thus has a display duty ratio of 1/240. A frame start pulse (FP1) is then generated after two hundred and forty line clock pulses (LC1, . . . L240) in order to clear the line clock counter (not shown) of the LCD module. The frame start pulse (FP1) permits the first lines of upper and lower picture data to appear respectively on the first lines of the upper and lower LCD panels 12, 13.

The following problems are usually encountered if an interlaced scanning system is applied to the above described conventional LCD module:

1. Because the conventional LCD module is adapted for use in a sequential scanning system, picture distortion occurs if an interlaced picture data is applied to the conventional LCD module. If interlaced picture data was applied, the picture data is compressed and is shown on the upper and lower LCD panels 12, 13 of the conventional twin-panel LCD module. Interlacing of the odd and even fields does not occur, thereby resulting in picture distortion and in the generation of flickers.

2. Since the frame start pulse (FP1) permits the first lines of upper and lower picture data to appear respectively on the first lines of the upper and lower LCD panels 12, 13 of the LCD module regardless of whether the picture data constitute the odd or even fields of one frame of picture data, the odd and even data fields are shown on the same lines of the upper and lower LCD panels 12, 13, thereby resulting in flickers.

SUMMARY OF THE INVENTION

Therefore, the objective of the present invention is to provide a method for controlling a liquid crystal display (LCD) module to show interlaced picture data thereon.

Accordingly, the method of the present invention comprises the steps of:

(a) providing a data field of interlaced picture data to an LCD module, the data field including a series of line picture data;

(b) providing twin line clock pulses to the LCD module to control latching of each line picture data thereby; and (c) providing a frame start pulse to the LCD module whenever a first one of the line picture data is provided to the LCD module, the frame start pulse having a first width that is sufficient to control the LCD module to show the first one of the line picture data on a first even line of the LCD module when the data field is an even data field, and a second width that is sufficient to control the LCD module to show the first one of the line picture data on a first odd line of the LCD module when the data field is an odd data field.

The twin line clock pulses and the frame start pulse ensure that the line picture data of the even and odd data fields are shown alternately and respectively on even and odd lines of the LCD module.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENTS

In order to achieve an interlaced scanning effect, even and odd data fields must be shown alternately and respectively on even and odd lines of a conventional LCD module.

Figure 1:
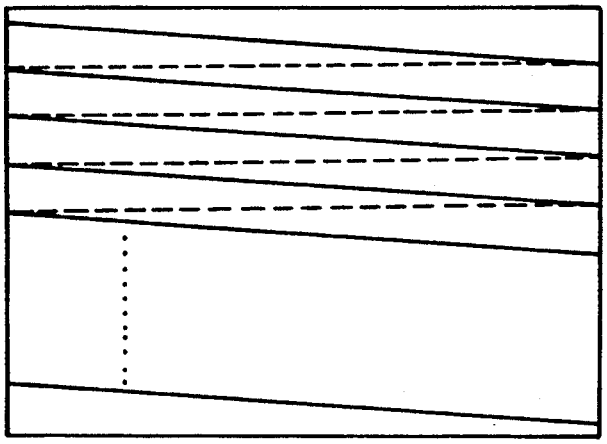
FIG. 1 PRIOR ART
FIG. 1 is an illustration of a conventional sequential scanning pattern.
Figure 2:
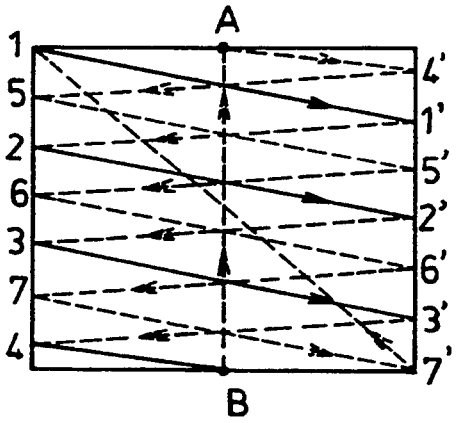
FIG. 2 PRIOR ART
FIG. 2 is an illustration of a conventional interlaced scanning pattern.
Figure 3:
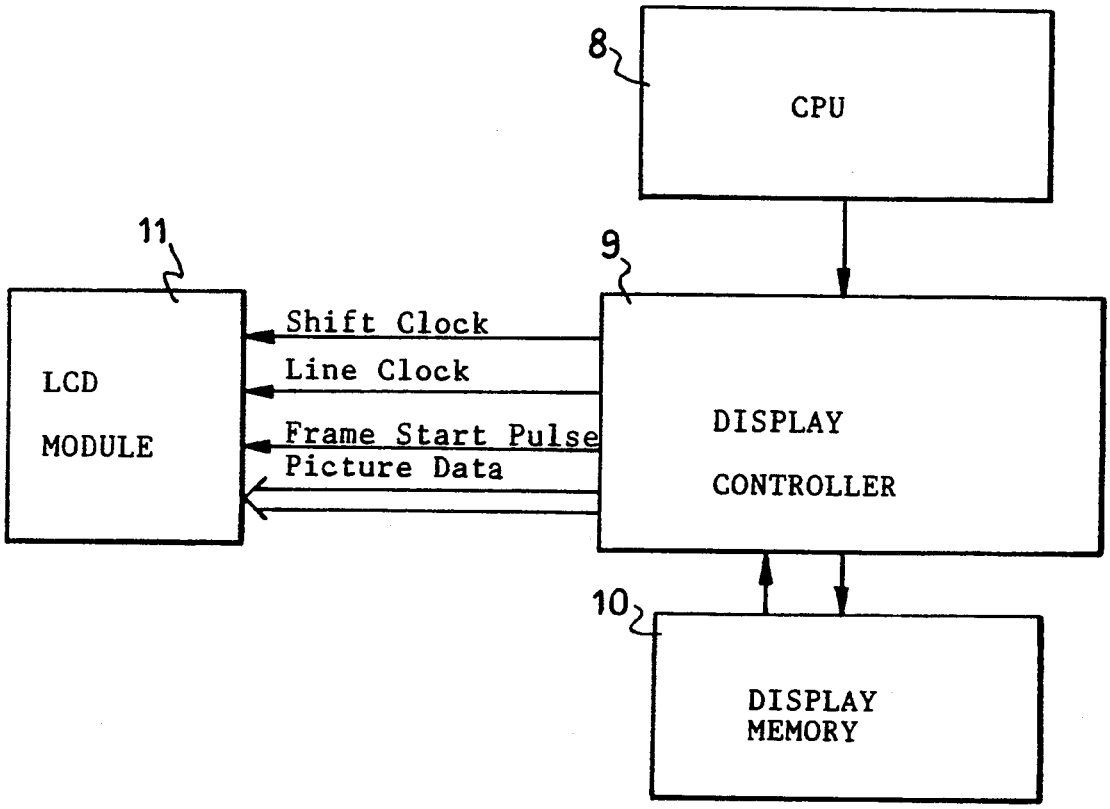
FIG. 3 PRIOR ART
FIG. 3 is a schematic circuit block diagram of a conventional LCD system.
Figure 4:
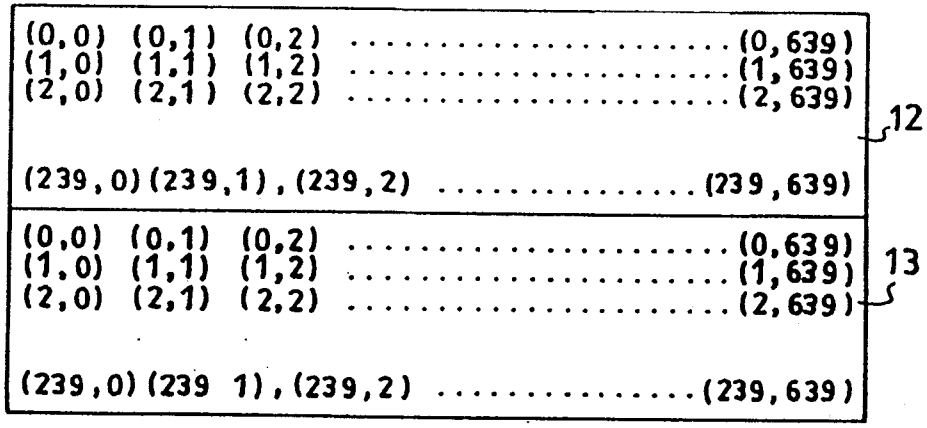
FIG. 4 PRIOR ART
FIG. 4 illustrates a conventional twin-panel LCD module.
Figure 5:
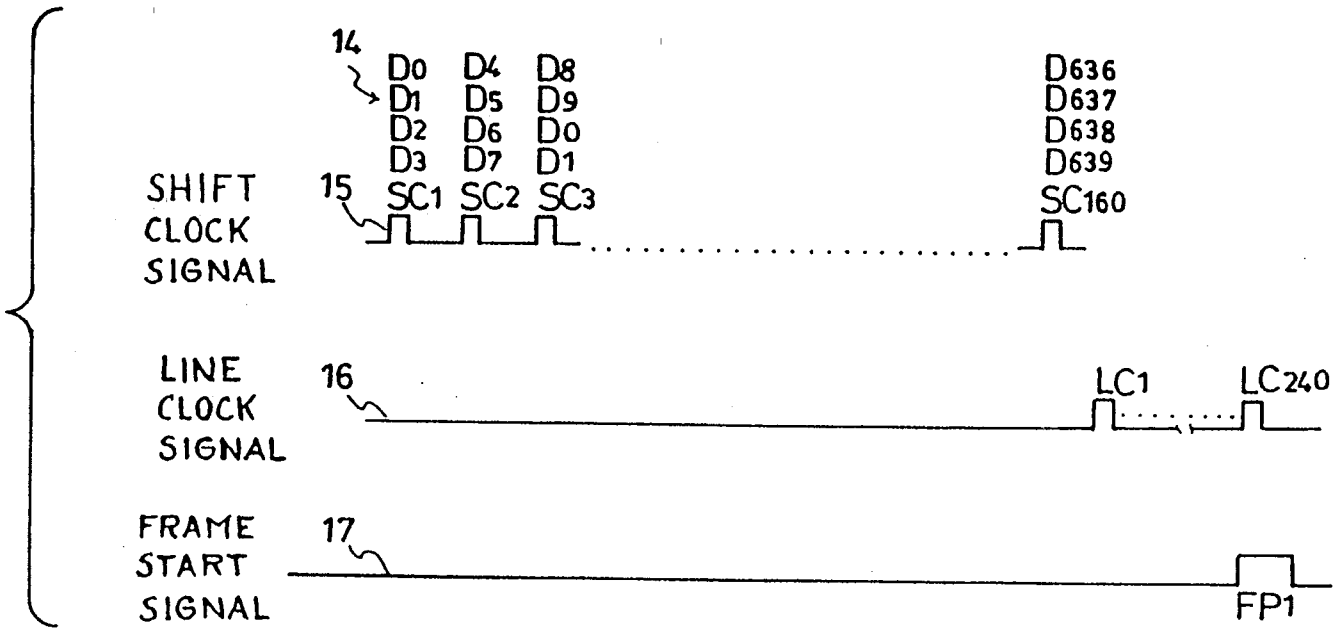
FIG. 5 PRIOR ART
FIG. 5 illustrates a timing diagram of various control signals of a conventional LCD system.
Figure 6:
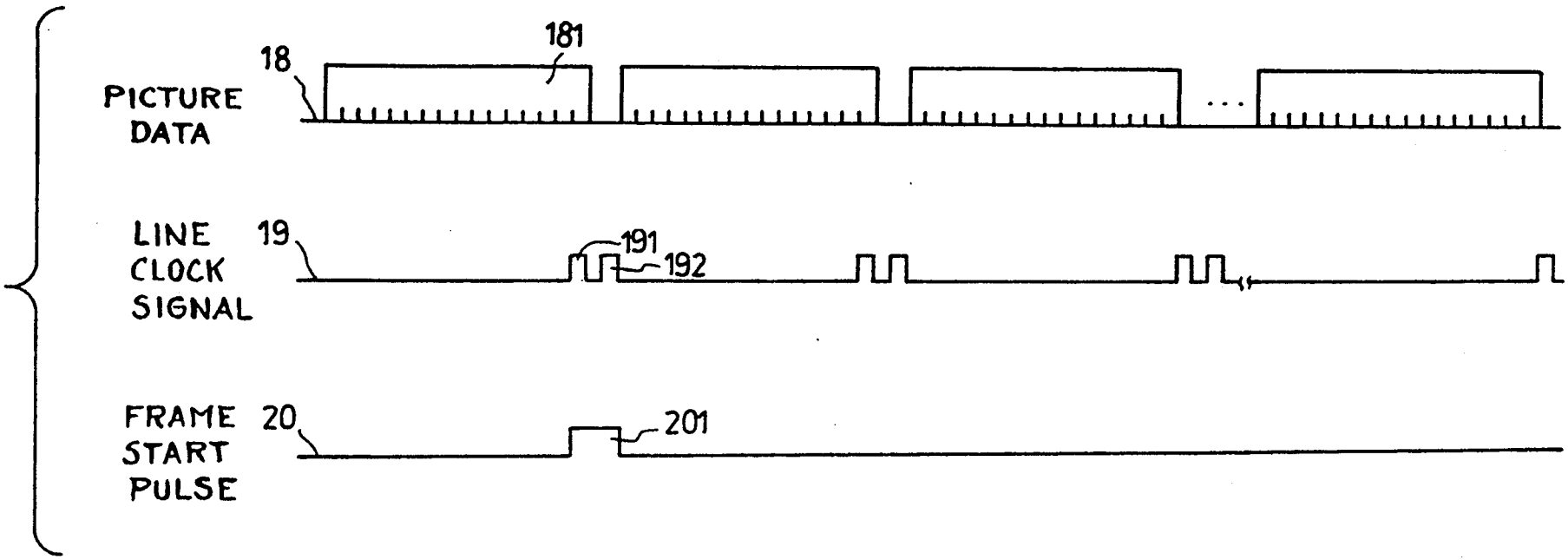
FIG. 6 is a signal diagram illustrating the method of the present invention when an even data field is applied to a conventional LCD panel.
Figure 7:
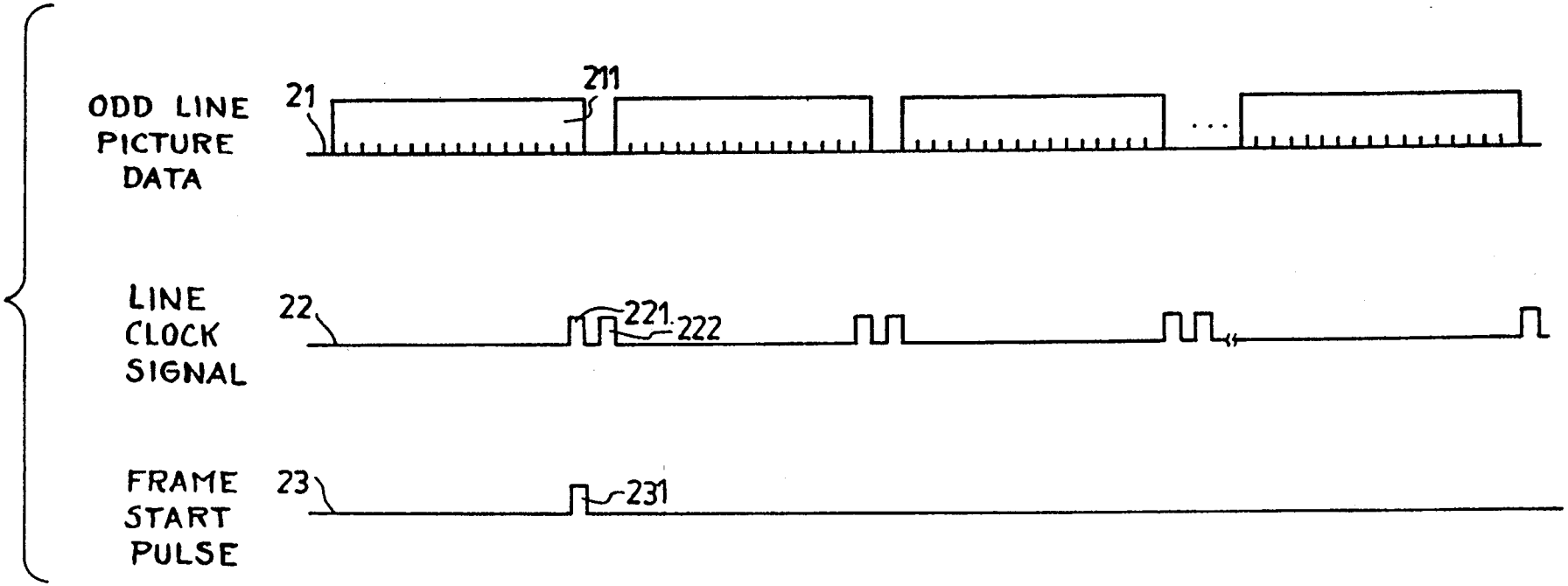
FIG. 7 is a signal diagram illustrating the method of the present invention when an odd data field is applied to the conventional LCD panel.

Referring to FIG. 6, a display controller (not shown) of the LCD system provides a series of even line picture data 18, a line clock signal 19 and a frame start pulse 20 to an LCD module (not shown) when an even picture field is to be shown on the latter. Similarly, the display controller provides a series of odd line picture data 21, a line clock signal 22 and a frame start pulse 23 to the LCD module when an odd picture field is to be shown on the latter, as shown in FIG. 7.

With reference to FIG. 6, the line clock signal 19 includes twin line clock pulses 191, 192 which are generated at the end of each even line picture data 181 to control latching of the line picture data 181 by the LCD module. A predetermined interval equal to one shift clock is present between the line clock pulses 191, 192. Since there are one hundred and sixty shift clock pulses in each line of a conventional 640×480 LCD module, the display duty ratio of even lines of the LCD module during an even field scanning operation is 1/120, while the display duty ratio of odd lines of the LCD module is 1/(120×160). Since the duty ratio of the odd lines is only 1/160th of the duty ratio of the even lines, and since the response time of a conventional passive matrix-type LCD panel is roughly 160 ms., the odd lines do not affect the even lines, thereby preventing the occurrence of crosstalk.

The above described procedure is repeated during an odd field scanning operation. With reference to FIG. 7, the line clock signal 22 includes twin line clock pulses 221, 222 which are generated at the end of each odd line picture data 211 to control latching of the line picture data 211 by the LCD module. Similarly, a predetermined interval equal to one shift clock is present between the line clock pulses 221, 222. The effect of the twin line clock pulses 221, 222 is similar to that of the twin line clock pulses 191, 192 and will not be detailed further.

Aside from the twin line clock pulses introduced in the method of the present invention, the frame start pulse is also modified so that the first even line data appears on the first even line of the LCD module, while the first odd line data appears on the first odd line of the LCD module, thereby reducing correspondingly the presence of flickers. In the method of the present invention, the width of the frame start pulse is varied in order to permit proper positioning of the even and odd line picture data on the LCD module.

The frame start pulse is generated whenever a first line picture data of the even or odd data fields is provided to the LCD module. Referring again to FIG. 6, during an even field scanning operation, the duration of the frame start pulse 201 starts from the leading edge of a first one of the line clock pulses 191 and ends at the lagging edge of a second one of the line clock pulses 192, thereby ensuring that the first even line data appears on the first even line of the LCD module. Referring again to FIG. 7, during an odd field scanning operation, the duration of the frame start pulse 231 starts from the leading edge of a first one of the line clock pulses 221 and ends at the lagging edge of the first one of the line clock pulses 221, thereby ensuring that the first odd line data appears on the first odd line of the LCD module. The odd and even fields are thus prevented from overlapping. The interlaced odd and even fields constitute a complete frame of picture data. For a complete frame of picture data, the average display duty ratio is 1/240. The noise duty ratio is 1/(240×160), which is very small and insufficient to cause picture distortion.

Figure 8:
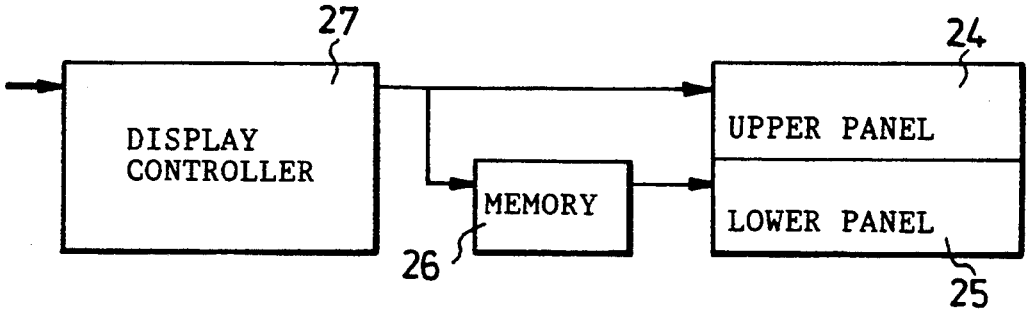
FIGS. 8 and 9 illustrate the method of the present invention when applied to a twin-panel LCD module.
Figure 9:
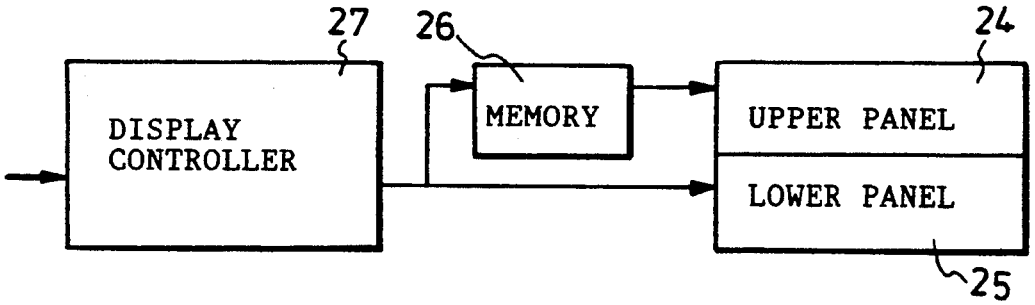

Finally, in a twin-panel LCD module, picture data must be simultaneously shown on the upper and lower LCD panels of the LCD module. With reference to FIGS. 8 and 9, an even or odd data field is divided into upper and lower field portions which are respectively shown on the upper and lower LCD panels 24, 25 of the LCD module.

Referring to FIG. 8, when the upper panel 24 is being scanned during an even field scanning operation, the upper panel 24 receives the line picture data corresponding to the upper field portion of a particular even data field from the display controller 27. The lower panel 25, however, receives the line picture data corresponding to the lower field portion of a previous even data field from an even field section of a memory unit 26. The line picture data of the upper field portion of the particular even data field is then written into the even field section of the memory unit 26 in order to replace the line picture data of the lower field portion of the previous even data field. This operation is known as a read-modify-write operation.

Referring to FIG. 9, the lower panel 25 is scanned after scanning of the upper panel 24 has been accomplished during the even field scanning operation. The lower panel 25 receives the line picture data corresponding to the lower field portion of the particular even data field from the display controller 27. The upper panel 24, however, retrieves the line picture data of the upper field portion of the particular even data field from the even field section of the memory unit 26. The line picture data of the lower field portion of the particular even data field is then written into the even field section of the memory unit 26 so as to replace the line picture data of the upper field portion of the particular even data field for use in a succeeding even field scanning operation.

The above described procedure is repeated when the upper and lower LCD panels 24, 25 are scanned during an odd field scanning operation. Data, however, is stored into and retrieved from an odd field section of the memory unit 26.

Therefore, for a twin-panel LCD module, the memory requirement is computed as follows:

$\frac{1}{2}$ (even field memory size+odd field memory size)=$\frac{1}{2}$ screen memory size For a 640×480 twin-panel LCD module, $\frac{1}{2}$ of the screen memory size is equal to $\frac{1}{2}\times640\times480\times N=153.6\times N$ kilobits, wherein N is equal to the number of bits per pixel. N is equal to 1 for a black and white LCD module and is equal to an integer that is greater than 1 for a colored LCD module.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A method for controlling an LCD module to show interlaced picture data thereon, comprising the steps of:

(a) providing a data field of said interlaced picture data to said LCD module, said data field including a series of line picture data;

(b) providing twin line clock pulses to said LCD module to control latching of each said line picture data by said LCD module; and (c) providing a frame start pulse to said LCD module whenever a first one of said line picture data is provided to said LCD module, said frame start pulse having a first width sufficient to control said LCD module to show said first one of said line picture data on a first even line of said LCD module when said data field is an even data field, and a second width sufficient to control said LCD module to show said first one of said line picture data on a first odd line of said LCD module when said data field is an odd data field;

whereby, said twin line clock pulses and said frame start pulse ensure that said line picture data of said even and odd data fields are shown alternately and respectively on even and odd lines of said LCD module.

2. The method as claimed in claim 1, wherein a predetermined interval equal to one shift clock is present between line clock pulses of said twin line clock pulses.

3. The method as claimed in claim 1, wherein said first width starts from a leading edge of a first line clock pulse of said twin line clock pulses and ends at a lagging edge of a second line clock pulse of said twin line clock pulses, and said second width starts from the leading edge of the first line clock pulse of said twin line clock pulses and ends at a lagging edge of the first line clock pulse of said twin line clock pulses.

4. A method for controlling a twin-panel LCD module to show interlaced picture data thereon, said LCD module including upper and lower LCD panels, said method comprising the steps of:

(a) when scanning said upper LCD panel, (a1) providing a series of line picture data of fan upper field portion of a particular data field of said interlaced picture data from a display controller to said upper LCD panel;

(a2) providing a series of line picture data of a lower field portion of a previous data field of said interlaced picture data from a memory unit to said lower LCD panel, said previous data field being an even data field if said particular data field is an even data field and being an odd data field if said particular data field is an odd data field; and (a3) writing said line picture data of the upper field portion of the particular data field into said memory unit to replace said line picture data of the lower field portion of the previous data field;

(b) when scanning said lower LCD panel, (b1) providing a series of line picture data of a lower field portion of the particular data field from the display controller to said lower LCD panel;

(b2) providing said line picture data of the upper field portion of the particular data field from the memory unit to said upper LCD panel; and (b3) writing said line picture data of the lower field portion of the particular data field into said memory unit to replace said line picture data of the upper field portion of the particular data field;

(c) providing twin line clock pulses to said upper and lower LCD panels to control latching of each said line picture data by said upper and lower LCD panels; and (d) providing a frame start pulse to said upper and lower LCD panels whenever a first one of said line picture data of said upper and lower field portions is provided thereto, said frame start pulse having a first width sufficient to control said upper and lower LCD panels to show said first one of said line picture data on a first even line thereof when said particular data field is an even data field, and a second width sufficient to control said upper and lower LCD panels to show said first one of said line picture data on a first odd line thereof when said particular data field is an odd data field.

5. The method as claimed in claim 4, wherein a predetermined interval equal to one shift clock is present between line clock pulses of said twin line clock pulses.

6. The method as claimed in claim 4, wherein said first width starts from a leading edge of a first line clock pulse of said twin line clock pulses and ends at a lagging edge of a second line clock pulse of said twin line clock pulses, and said second width starts from the leading edge of the first line clock pulse of said twin line clock pulses and ends at a lagging edge of the first line clock pulse of said twin line clock pulses.

* * * * *

UNITED STATES PATENT AND TRADEMARK OFFICE

CERTIFICATE OF CORRECTION

PATENT NO. : 5,386,217

DATED : January 31, 1995

INVENTOR(S) : Hsiung-Hao Liu et al

It is certified that error appears in the above-indentified patent and that said Letters Patent is hereby corrected as shown below:

Column 6, line 9, Claim 4, "fan" should be --an--.

Signed and Sealed this

Twenty-fifth Day of April, 1995

*Attest:*

Bruce Lehman

BRUCE LEHMAN

*Attesting Officer*

*Commissioner of Patents and Trademarks*